US011828480B2

(12) United States Patent
Mu

(10) Patent No.: US 11,828,480 B2
(45) Date of Patent: Nov. 28, 2023

(54) SYSTEM AND METHOD FOR CONTROLLING AIR FLOW IN AIR HANDLING UNIT

(71) Applicant: Rheem Manufacturing Company, Atlanta, GA (US)

(72) Inventor: Baojie Mu, Aubey, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 525 days.

(21) Appl. No.: 17/123,510

(22) Filed: Dec. 16, 2020

(65) Prior Publication Data

US 2022/0186969 A1 Jun. 16, 2022

(51) Int. Cl.

| | |
|---|---|
| ***F24F 11/64*** | (2018.01) |
| ***F24F 11/75*** | (2018.01) |
| ***F24F 11/76*** | (2018.01) |
| *F24F 110/40* | (2018.01) |
| *F24F 110/10* | (2018.01) |
| *F24F 110/20* | (2018.01) |

(52) U.S. Cl.

CPC ..... *F24F 11/75* (2018.01); *F24F 11/76* (2018.01); *F24F 11/64* (2018.01); *F24F 2110/10* (2018.01); *F24F 2110/20* (2018.01); *F24F 2110/40* (2018.01)

(58) Field of Classification Search

CPC .. F24F 11/75; F24F 11/76; F24F 11/64; F24F 2110/10; F24F 2110/20; F24F 2110/40

USPC ..... 700/276

See application file for complete search history.

(56) References Cited

U.S. PATENT DOCUMENTS

2005/0278070 A1* 12/2005 Bash ..... H05K 7/20836 700/291
2012/0171050 A1* 7/2012 Havard, Jr. ..... F04D 27/004 417/44.1
2019/0331123 A1* 10/2019 Yang ..... F04D 27/004
2020/0300497 A1* 9/2020 Goel ..... F24F 11/65

FOREIGN PATENT DOCUMENTS

| | | | |
|---|---|---|---|
| CN | 208382463 | U | 1/2019 |
| FR | 3022615 | A1 | 12/2015 |
| RU | 2716917 | C1 | 3/2020 |

OTHER PUBLICATIONS

International Search Report and Written Opinion for PCT Application No. PCT/US2021/063464 dated Apr. 7, 2022.

* cited by examiner

*Primary Examiner* — Jigneshkumar C Patel
(74) *Attorney, Agent, or Firm* — Eversheds Sutherland (US) LLP

(57) ABSTRACT

A system for controlling air flow in an air handling unit having an air mover is provided. The system includes a first and a second sensing device, each receiving a first input indicative of electric power and a second input indicative of properties of air, respectively. The system further includes a processing unit to determine heat generated from a motor of the air mover based on the first input, determine density of air based on the heat generated from the motor based on the second input, and determine an actual air flow rate based on the density of the air, a speed of the motor, and dimensional characteristics of the air handling unit. Further, the speed of the motor is controlled when the actual air flow rate is different from a target air flow rate.

19 Claims, 3 Drawing Sheets

SYSTEM AND METHOD FOR CONTROLLING AIR FLOW IN AIR HANDLING UNIT

TECHNICAL FIELD

The present disclosure relates, in general, to an air handling unit and, more specifically relates, to a system and a method for controlling air flow in an air handling unit.

BACKGROUND

Air handling units such as heat pumps, air conditioners, and heating, ventilation and air conditioning (HVAC) systems are used in domestic, commercial and other industrial applications. A heating unit associated with a HVAC system includes a heat exchanger, an air mover, and heating elements such as burner and combustion chamber for conditioning air. The HVAC system also includes air return duct to receive air and an air supply duct to supply conditioned air to required space. The air mover is used for receiving the air through the air return duct and discharge a volume of air over the heat exchanger. The rate at which the volume of air discharged, measured in terms of cubic feet per minute (CFM), by the air mover is a critical operational parameter used for improving performance of the heat exchanger and hence the operational efficiency of the HVAC system.

In general, volume of air delivered by the air mover in the HVAC system varies with overall dimension of the HVAC system, air mover motor speed, static pressure of the system and thermodynamic properties of air received through the air return duct. For a desired air flow rate at a specific operating condition, the HVAC manufacturer usually develops tabular data to relate the air mover motor speed and the system pressure with the desired air flow rate. The tabular data may often lead to deficiencies in the performance of the system as the system is not capable of predicting variation in the operating parameters in real time. Hence, there remains a need to detect the operating parameters in real time and thereby control the operation in real time to further improve operational efficiency of the system.

SUMMARY

According to one aspect of the present disclosure, a system for controlling air flow in an air handling unit having an air mover is disclosed. The system includes a first sensing device configured to receive a first input indicative of an electric power supplied to the air handling unit. The first sensing device is in communication with a motor of the air mover and the first input indicative of the electric power includes current, voltage or a combination thereof. The system further includes a second sensing device configured to receive a second input indicative of properties of air received within the air handling unit. The second sensing device is in communication with an air inlet duct of the air handling unit and the second input indicative of the properties of air includes pressure, temperature, humidity or a combination thereof. The system further includes a processing unit in communication with the first sensing device and the second sensing device. The processing unit is configured to determine heat generated from a motor of the air mover based on the first input, determine density of air received by the air mover based on the heat generated from the motor and the second input, and determine an actual air flow rate based on the density of the air, a speed of the motor, and dimensional characteristics of the air handling unit. The processing unit is further configured to compare the actual air flow rate with a target air flow rate stored in the processing unit and control the speed of the motor when the actual air flow rate is different from the target air flow rate.

In an embodiment, the processing unit includes an electric module configured to store dimensional characteristics of the motor and characteristics of the electric power. The characteristics of the electric power includes resistance, capacitance, reluctance, frequency, or a combination thereof. The electric module is further configured to receive the first input indicative of the electric power and determine the heat generated from the motor based on the dimensional characteristics of the motor, the characteristics of the electric power, and the first input. The processing unit further includes an air property module in communication with the electric module and configured to determine the density of the air based on the heat generated from the motor and the second input. The processing unit further includes a mechanical module configured to store the dimensional characteristics of the motor and dimensional characteristics of the air inlet duct. The mechanical module is configured to determine the dimensional characteristics of the air handling unit based on the stored dimensional characteristics of the motor and the air inlet duct. The processing unit further includes a hydraulic module in communication with the air property module and the mechanical module. The hydraulic module is configured to receive the density of the air, receive the dimensional characteristics of the air handling unit, receive the speed of the motor, and determine the actual air flow rate based on the density of the air, the dimensional characteristics of the air handling unit, and the speed of the motor. In one embodiment, the system includes a speed sensor in communication with the motor of the air mover and configured to communicate the speed of the motor with the processing unit. In another embodiment, the first sensing device is configured to communicate the speed of the motor with the processing unit. The processing unit further includes a control module in communication with the hydraulic module. The control module is configured to store the target air flow rate, compare the actual air flow rate with the target air flow rate, and increase the speed of the motor when the actual air flow rate is less than the target air flow rate.

According to another aspect of the present disclosure, a method of controlling air flow in an air handling unit having an air mover is disclosed. The method includes receiving, by a first sensing device, a first input indicative of an electric power supplied to the air handling unit. The first input indicative of the electric power includes current, voltage or a combination thereof. The method further includes receiving, by a second sensing device, a second input indicative of properties of air received within the air handling unit. The second input indicative of the properties of air includes pressure, temperature, humidity or a combination thereof. The method further includes determining, by a processing unit, heat generated from a motor of the air mover based on the first input, determining density of air received through an air inlet duct of the air handling unit based on the heat generated from the motor and the second input, and determining an actual air flow rate based on the density of the air, a speed of the motor and dimensional characteristics of the air handling unit. The method further includes comparing the actual air flow rate with a target air flow rate stored in the processing unit and controlling the speed of the motor when the actual air flow rate is different from the target air flow rate.

In an embodiment, the method further includes storing, by an electric module of the processing unit, dimensional characteristics of the motor and characteristics of the electric power, receiving the first input indicative of the electric power, and determining the heat generated from the motor based on the dimensional characteristics of the motor, the characteristics of the electric power, and the first input. The method further includes determining, by an air property module of the processing unit, the density of air based on the heat generated from the motor and the second input. The method further includes storing, by a mechanical module of the processing unit, the dimensional characteristics of the motor and dimensional characteristics of the air inlet duct, and determining the dimensional characteristics of the air handling unit based on the stored dimensional characteristics of the motor and the air inlet duct. The method further includes receiving, by a hydraulic module of the processing unit, the density of the air, receiving the dimensional characteristics of the air handling unit, receiving the speed of the motor, and determining the actual air flow rate based on the density of air, the dimensional characteristics of the air handling unit, and the speed of the motor. The method further includes storing, by a control module of the processing unit, the target air flow rate, comparing the actual air flow rate with the target air flow rate, and increasing the speed of the motor when the actual air flow rate is less than the target air flow rate.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
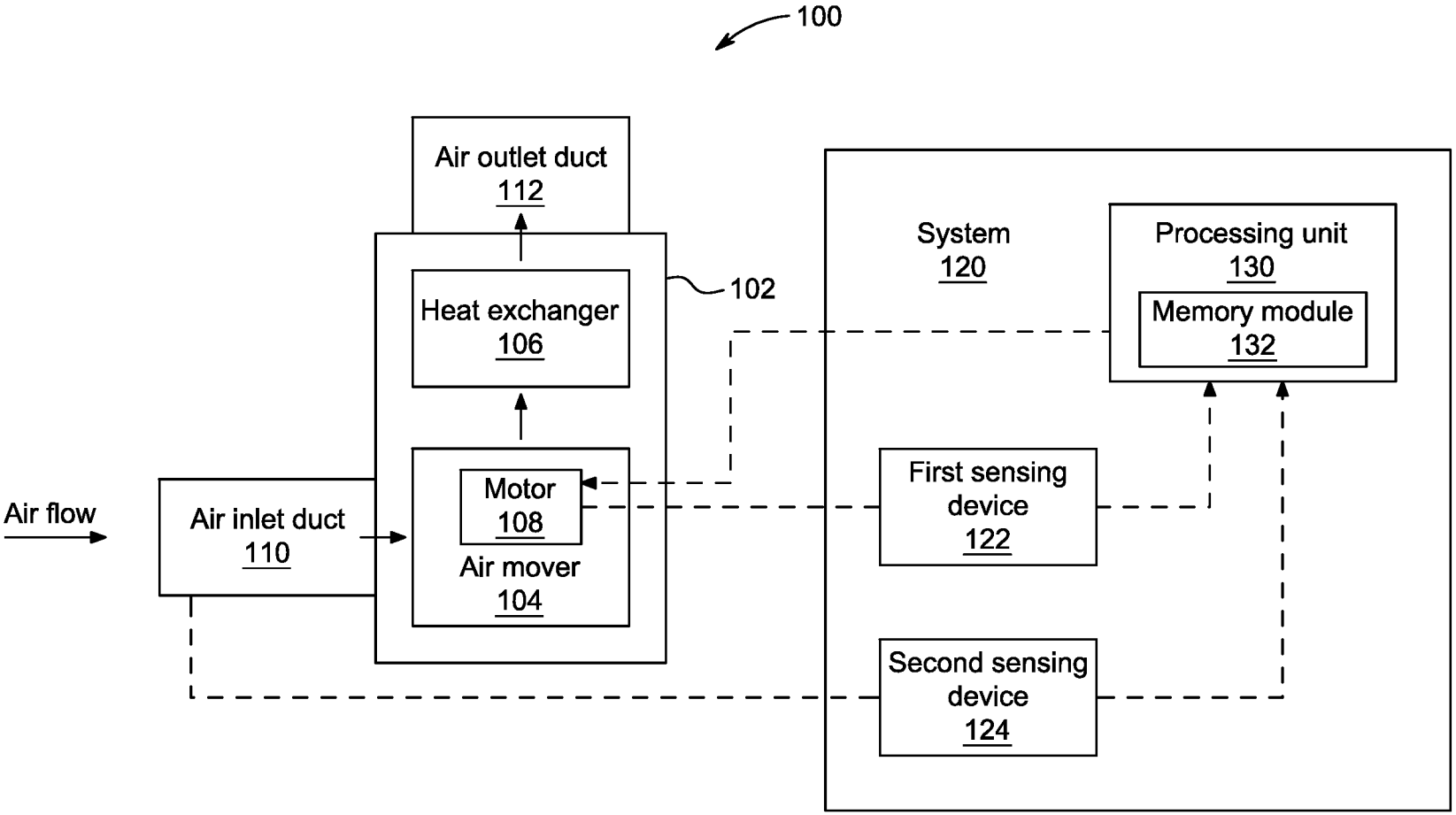
FIG. 1 is a schematic block diagram of an air handling unit, according to an embodiment of the present disclosure.

Referring to FIG. 1, a schematic block diagram of an air handling unit 100 is illustrated, according to an embodiment of the present disclosure. The air handling unit 100 is depicted as a gas furnace to supply warm air to a closed space. In some embodiments, the air handling units 100 may include, but are not limited to, heat pumps, air conditioners, and heating, ventilation and air conditioning (HVAC) systems. The air handling unit 100 may be implemented in domestic, commercial, or any other known industrial applications. The air handling unit 100 includes a housing 102 to accommodate an air mover 104, a heat exchanger 106 and other components such as a burner and a combustion chamber for supplying warm air to the closed space. The air mover 104 is disposed at bottom of the housing 102 and the heat exchanger 106 is disposed above the air mover 104. Further, components such as the burner and the combustion chamber may be disposed between the air mover 104 and the heat exchanger 106.

The air mover 104 includes a motor 108 and multiple rotating blades, otherwise known as impellers, for receiving air and discharging the air at high pressure. The air handling unit 100 may be used to receive cool air and supply warm air to the closed space. The air handling unit 100 further includes an air inlet duct 110 configured to receive the cool air therethrough. The cool air may be ambient air or air that is present in the closed space. One end of the air inlet duct 110 is configured to receive the cool air and another end is fluidly coupled with the bottom of the housing 102 such that the air inlet duct 110 is aligned with the location and orientation of the air mover 104. The air handling unit 100 further includes an air outlet duct 112 in fluid communication with the housing 102 and the heat exchanger 106 to supply warm air to the closed space. The air handling unit 100 may further include a gas inlet pipe and a gas outlet pipe coupled with the housing 102 for the combustion purpose. The air handling unit 100 may further include a damper (not shown) disposed in the air outlet duct 112 to control the flow of warm air to the closed space.

The air handling unit 100 further includes a system 120 for controlling air flow within the housing 102 of the air handling unit 100. More specifically, the system 120 is in communication with the air mover 104 and various components of the air handling unit 100 for controlling a volume of air discharged by the air mover 104, which is measured in terms of cubic feet per minute (CFM). The system 120, according to the present disclosure, is used for controlling the CFM in real time to improve performance of the heat exchanger 106 and thereby the operational efficiency of the air handling unit 100.

The system 120 includes a first sensing device 122 configured to receive a first input indicative of an electric power supplied to the air handling unit 100. In one embodiment, the first sensing device 122 may include a sensor configured to receive the first input indicative of the electric power supplied to the air handling unit 100. The sensor may be in electric communication with an electric power source (not shown) of the air handling unit 100 to receive the first input indicative of the electric power. The first input indicative of the electric power may include current, voltage or a combination thereof. In another embodiment, the first sensing device 122 may include multiple sensors to receive the first input indicative of the electric power. Each sensor may be communicated with the electric power source to individually receive the first input indicative of the current and voltage. In certain embodiments, the first sensing device 122 may be in communication with the motor 108 of the air mover 104 to receive the first input indicative of the electric power supplied to the motor 108. Particularly, the current and the voltage of the electric power supplied to the motor 108 may be received by the first sensing device 122. In some embodiments, the first sensing device 122 may include any known devices that may detect current and voltage of the electric power supplied to the motor 108 and output a current value and a voltage value.

The system 120 further includes a second sensing device 124 configured to receive a second input indicative of properties of air received within the air handling unit 100. In one embodiment, the second sensing device 124 may include a sensor configured to receive the second input indicative of the properties of air received within the air handling unit 100. The sensor may be in communication with the air inlet duct 110 of the air handling unit 100 to receive the second input indicative of the properties of air received through the air inlet duct 110. The second input indicative of the properties of air may include pressure, temperature, humidity or a combination thereof. In another embodiment, the second sensing device 124 may include multiple sensors to receive the second input. In an example, the second sensing device 124 may include a pressure sensor, a temperature sensor and a humidity sensor to detect pressure, temperature and humidity, respectively, of the air received within the air inlet duct 110. Each sensor may be communicated with the air inlet duct 110 to individually receive the second input indicative of the pressure, temperature and humidity of the air. The second sensing device 124 may be disposed anywhere along a length of the air inlet duct 110. Alternatively, the second sensing device 124 may be disposed within the housing 102 proximate an air inlet of the air mover 104 and the air outlet duct 112 to receive the second input. In some embodiments, the second sensing device 124 may include any known devices that may detect pressure, temperature and humidity of the air and output a pressure value, a temperature value, and a humidity value, respectively.

The system 120 further includes a processing unit 130 in communication with the first sensing device 122 and the second sensing device 124. The processing unit 130 may be in a wired communication with the first sensing device 122 and the second sensing device 124. Alternatively, the processing unit 130 may be in a wireless communication with the first sensing device 122 and the second sensing device 124.

The processing unit 130 may be an electronic controller that operates in a logical fashion to perform operations, execute control algorithms, store and retrieve data and other desired operations. The processing unit 130 may include or access memory, secondary storage devices, processors, and any other components for running an application. The memory and secondary storage devices may be in the form of read-only memory (ROM) or random-access memory (RAM) or integrated circuitry that is accessible by the processing unit 130. Various other circuits may be associated with the processing unit 130 such as power supply circuitry, signal conditioning circuitry, driver circuitry, and other types of circuitry. Further, the processing unit 130 may be a single controller or may include multiple controllers disposed to control various functions and/or features of the air handling unit 100. The term "controller" is meant to be used in its broadest sense to include one or more controllers and/or microprocessors that may be associated with the air handling unit 100 and that may cooperate in controlling various functions and operations of the air handling unit 100. The processing unit 130 may rely on data relating to various dimensional characteristics of the air handling unit 100 as well as the lab test data captured based on the operational experiments of the air handling unit 130, which may be stored in the memory of the processing unit 130. The data may be presented in the form of tables, graphs, and/or equations.

The processing unit 130 is configured to determine heat generated from the motor 108 of the air mover 104 based on the first input. Particularly, the processing unit 130 determines the heat generated from the motor 108 based on the first input received from the first sensing device 122, and dimensional characteristics of the motor 108 and characteristics of the electric power stored in a memory module 132 of the processing unit 130. The processing unit 130 is further configured to determine density of air received through the air inlet duct 110 based on the heat generated from the motor 108 and the second input received from the second sensing device 124. The processing unit is further configured to determine an actual air flow rate based on the density of air, a speed of the motor 108, and dimensional characteristics of the air handling unit 100. The dimensional characteristics of the air handling unit 100 may be determined based on the dimensional characteristics of the motor 108 and dimensional characteristics of the air inlet duct 110. The processing unit 130 may receive the speed of the motor 108 using a speed sensor (shown in FIG. 2) or the first sensing device 122. The processing unit 130 is further configured to compare the actual air flow rate with a target air flow rate stored in the memory module 132. Further, the processing unit 130 may communicate with the motor 108 to control the speed thereof when the actual air flow rate is different from the target air flow rate.

Figure 2:
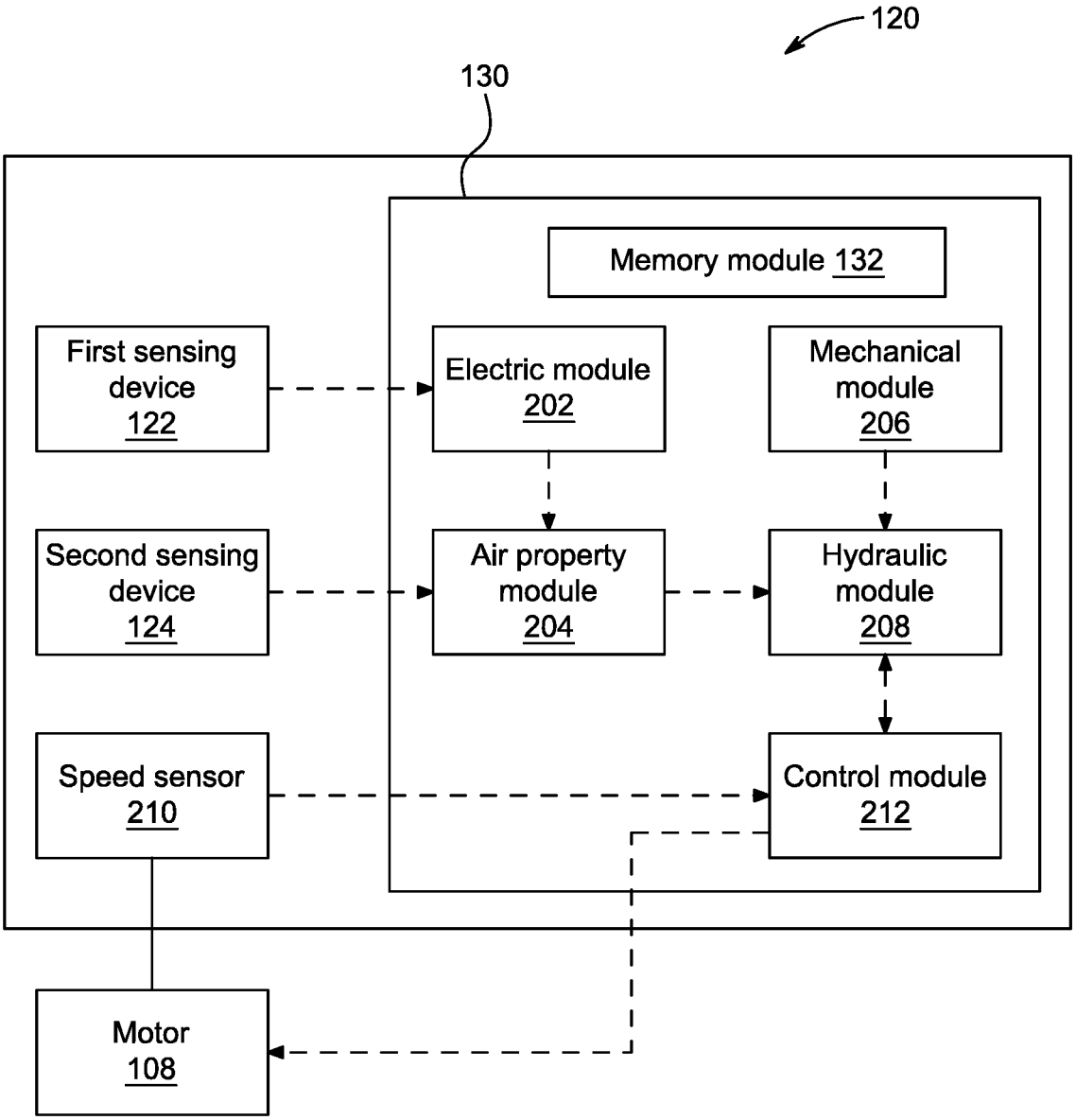
FIG. 2 is a schematic block diagram of a system for controlling air flow in the air handling unit, according to an embodiment of the present disclosure.

Referring to FIG. 2, a schematic block diagram of the system 120 for controlling air flow in the air handling unit 100 is illustrated, according to an embodiment of the present disclosure. The system 120 includes the first sensing device 122 to receive the first input and the second sensing device 124 to receive the second input. The first sensing device 122 and the second sensing device 124 are in electric communication with the processing unit 130. The processing unit 130 includes an electric module 202 in communication with the first sensing device 124 to receive the first input. The electric module 202 may be configured to receive a signal indicative of the first input from the first sensing device 122 and process the signal to determine the current value and the voltage value. Alternatively, the electric module 202 may directly receive the current value and the voltage value of the electric power supplied to the motor 108. The electric module 202 is further configured to store the dimensional characteristics of the motor 108 and the characteristics of the electric power. The dimensional characteristics of the motor 108 may be referred as the dimensional details of various elements of the motor 108 including, but not limited to, a stator, a rotor, a winding and a housing frame. The characteristics of the electric power includes resistance, capacitance, reluctance, frequency, or the combination thereof. The dimensional characteristics of the motor 108 and the characteristics of the electric power may be inputted by an operator of the air handling unit 100 and stored in the memory module 132 of the processing unit 130. In one example, the dimensional characteristic of the motor 108 and the characteristics of the electric power may be preset in the processing unit 130 during manufacturing of the air handling unit 100. In another example, the dimensional characteristic of the motor 108 and the characteristics of the electric power may be preset by the operator after commissioning the air handling unit 100 in the required place. The electric module 202 is further configured to determine the heat generated from the motor 108 based on inputs indicative of the dimensional characteristics of the motor 108, the characteristics of the electric power, and the first input.

The processing unit 130 further includes an air property module 204 in communication with the electric module 202. The air property module 204 is configured to determine the density of air based on inputs indicative of the heat generated from the motor 108 and the second input. The air property module 204 is configured to receive a signal indicative of the second input from the second sensing device 124 and process the signal to determine a pressure value, a temperature value and a humidity value. Alternatively, the air property module 204 may directly receive the value of the pressure, the temperature and the humidity of the air received through the air inlet duct 110. The air property module 204 may process the input indicative of the heat generated from the motor 108 and the second input to determine the density of the air. The density of air is directly proportional to pressure and indirectly proportional to temperature and humidity. As such, the second input indicative of the pressure, temperature and humidity of the air received within the air inlet duct 110 helps the air property module 204 to precisely determine the density of air. A mathematical relation between the pressure, temperature and humidity of the air may be established along with desired variables and assumptions to determine the density of air.

The processing unit 130 further includes a mechanical module 206 configured to store the dimensional characteristics of the motor and the dimensional characteristics of the air inlet duct 110. The dimensional characteristics of the air inlet duct 110 may be referred to as the dimensional details corresponding to size and shape of the air inlet duct 110 including, but not limited to, a volume defined by a length, a width and a height of the air inlet duct 110. The dimensional characteristics of the air inlet duct 110 may also include dimensional details of one or more air filters disposed within the air inlet duct 110. The dimensional characteristics of the motor 108 and the dimensional characteristics of the air inlet duct 110 may be inputted by the operator of the air handling unit 100 and stored in the memory module 132 of the processing unit 100. The mechanical module 206 is further configured to determine the dimensional characteristics of the air handling unit 100 based on the stored dimensional characteristics of the motor 108 and the air inlet duct 110.

In an alternate embodiment, the mechanical module 206 may be configured to determine the dimensional characteristics of the air handling unit 100 based on dimensional characteristics of the air outlet duct 112, the damper and the housing 102 of the air handling unit 100 in addition to the dimensional characteristics of the motor 108 and the air inlet duct 110. In such a case, the dimensional characteristics of the air outlet duct 112, the damper and the housing 102 of the air handling unit 100 may be inputted by the operator and stored in the memory module 132 of the processing unit 100. One or more of the dimensional characteristics of the motor 108, the air inlet duct 110, the air outlet duct 112, the damper and the housing 102 of the air handling unit 100 may be processed individually or collectively to determine a value corresponding to the dimensional characteristics of the air handling unit 100.

The processing unit 130 further includes a hydraulic module 208 in communication with the air property module 204 and the mechanical module 206. Specifically, the hydraulic module 208 is in communication with the air property module 204 to receive inputs indicative of the density of air and in communication with the mechanical module 206 to receive inputs indicative of the dimensional characteristics of the air handling unit 100. The hydraulic module 208 is further configured to receive the speed of the motor 108. In one embodiment, the system 120 may include a speed sensor 210 in communication with the motor 108. The speed sensor 210 may be configured to communicate an input indicative of the speed of the motor 108 with the processing unit 130. In one example, the speed sensor 210 may be configured to detect a signal indicative of a rotational speed of a motor shaft to determine the speed of the motor 108. In another example, the speed sensor 210 may be configured to detect a signal indicative of the electric power supplied to the motor 108 to determine the speed of the motor 108. In another embodiment, the first sensing device 122 may be configured to communicate the speed of the motor 108 with the processing unit 100. The first input indicative of the current and voltage of the electric power supplied to the motor 108 may be communicated to the hydraulic module 208 by the first sensing device 122 to determine the speed of the motor 108.

The hydraulic module 208 is further configured to determine the actual air flow rate based on the density of air, the dimensional characteristics of the air handling unit 100, and the speed of the motor 108. The air flow rate may be defined as a quantity or volume of air discharged by the air mover 104 in a predefined time period, which is measured in terms of cubic feet per minute (CFM). Based on the density of air, the dimensional characteristics of the air handling unit 100 and the speed of the motor 108, the hydraulic module 208 determines the volume of air discharged by the air mover 104. More particularly, the hydraulic module 208 is configured to receive the inputs indicative of the density of air, the dimensional characteristics of the air handling unit 100, and the speed of the motor 108 in real time and determine the actual air flow rate during the operation of the air handling unit 100. As such, the hydraulic module 208 determines the real time air flow rate of the air mover 104. In an example, a mathematical relation may be established among the density of air, the dimensional characteristics of the air handling unit 100, and the speed of the motor 108 to determine the actual air flow rate.

The processing unit 130 further includes a control module 212 in communication with the hydraulic module 208 and the speed sensor 210. As such, the speed of the motor 108 may be communicated with the hydraulic module 208 by the control module 212. Alternatively, the speed sensor 210 may be communicated with the hydraulic module 208. The control module 212 is configured to store the target air flow rate. The target air flow rate may be predefined based on various factors including, but not limited to, input power and heating capacity of the air handling unit 100 and power rating of the various components such as the air mover 104, the heat exchange 106, and the burner of the air handling unit 100. Alternatively, the target air flow rate may be predefined based on test lab data established during the operational experiments of the air handling unit 100. In an example, for a given static pressure of the air received through the air inlet duct 110 and the dimensional characteristics of the air handling unit 100, the speed of the motor 108 and the corresponding air flow rate may be determined. The target air flow rate may be inputted by the operator and stored in the memory module 132 of the processing unit 130. The control module 212 is further configured to compare the actual air flow rate with the target air flow rate. The control module 212 receives the input indicative of the actual air flow rate from the hydraulic module 208 and compare the actual air flow rate with the target air flow rate preset in the processing unit 130.

The control module 212 is further configured to increase the speed of the motor 108 when the actual air flow rate is less than the target air flow rate. The control module 212 is further in communication with the motor 108 of the air mover 104. When the actual air flow rate determined in real time is less than the target air flow rate, the control module 212 may output a signal indicative of a difference value between the target air flow rate and the actual air flow rate to the motor 108. Such that the speed of the motor 108 is increased based on the difference value to increase the actual air flow rate to match with the target air flow rate. In an embodiment, the control module 212 may be in communication with the electric power supplied to the motor 108 such that the speed of the motor 108 may be increased by adjusting the current and the voltage. When the actual air flow rate is equal to the target air flow rate, the control module 212 does not take any action with the motor 108 and the motor 108 is allowed to rotate at the same speed to maintain the air flow rate. Further, when the actual air flow rate is greater than the target air flow rate, the control module 212 may communicate with the motor 108 to adjust the speed thereof and to match the actual air flow rate with the target air flow rate.

In an embodiment, the design and development of the system 120 may be established based on the below mathematical relation between two or more of the operational parameters such as the static pressure (SP), the air flow rate (Q), speed (w) of the motor 108, and dimensional characteristics (D) of the air handling unit 100. For a given static pressure (SP) of the air handling unit 100, the air flow rate (Q) is a function of the speed (w) of the motor 108 and the dimensional characteristics (D) of the air handling unit 100. In an example, a mathematical relation for establishing the air flow rate (Q) is:

$$\frac{Q}{Q_{norm}} = \left(\frac{D}{D_{norm}}\right)^3 \frac{w}{w_{norm}}$$

Further, static pressure (SP) of the air handling unit 100 may be determined by a mathematical relation:

$$\frac{SP}{SP_{norm}} = \left(\frac{D}{D_{norm}}\right)^2 \left(\frac{w}{w_{norm}}\right)^2 \frac{d}{d_{norm}}$$

Where, d' is the density of air.

Further, the relation between the air flow rate (Q) and the static pressure (SP) may be described as:

$Q=f(\mathrm{SP},D,w)$, where $\mathrm{SP}=f(D,w,d)$

As such, the speed of the motor 108 is estimated in real time which, along the dimensional characteristics of the air handling unit 100 and the density of air, is used to determine the actual air flow rate in real time.

Figure 3:
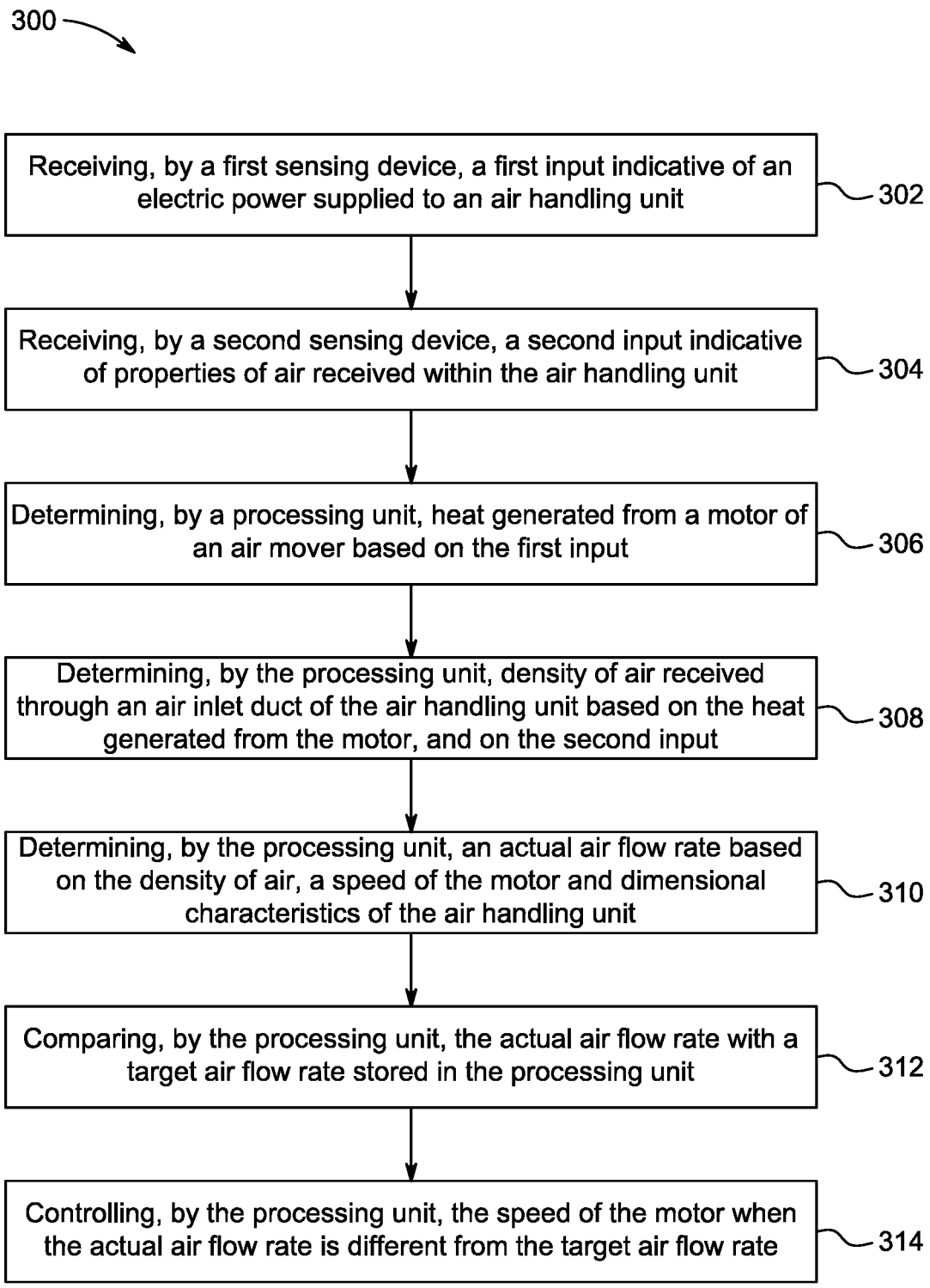
FIG. 3 is a schematic flow diagram of a method of controlling air flow in the air handling unit, according to an embodiment of the present disclosure.

Referring to FIG. 3, a flow diagram of a method 300 of controlling the air flow in the air handling unit 100 is illustrated, according to an embodiment of the present disclosure. The method 300 is described with reference to the system illustrated in FIG. 1 and FIG. 2. The method 300 may be described in the general context of computer executable instructions which may be located in both, local and remote computer storage media, including memory storage devices. The order in which the method 300 is described is not intended to be construed as a limitation, and any number of the described method steps can be combined in any order to implement the method 300. Additionally, individual steps may be deleted from the method 300 without departing from the spirit and scope of the present disclosure. In an embodiment, the method 300 may be executed by the processing unit 130 of the present disclosure.

At step 302, the method 300 includes receiving the first input indicative of the electric power supplied to the air handling unit 100. The first input indicative of the electric power may include current, voltage or the combination thereof. The first sensing device 122 disposed in communication with the electric power source of the air handling unit 100 may receive the first input. Alternatively, the first sensing device 122 disposed in communication with the motor 108 may receive the first input.

At step 304, the method 200 includes receiving the second input indicative of the properties of air received within the air handling unit 100. The second input indicative of the properties of air may include pressure, temperature, humidity or the combination thereof. The second sensing device 124 disposed in communication with the air inlet duct 110 of the air handling unit 100 may receive the second input.

At step 306, the method 300 includes determining the heat generated from the motor 108 based on the first input. The processing unit 130 receives the first input from the first sensing device 122. Upon receiving the first input, the processing unit 130 may process the dimensional characteristics of the motor 108 and the characteristics of the electric power stored in the memory module 132 along with the first input, and then determine the heat generated from the motor 108. In an alternate embodiment, the electric module 202 disposed in communication with the first sensing device 122 receives the first input. The electric module 202 further stores the dimensional characteristics of the motor 108 and the characteristics of the electric power. The characteristics of the electric power includes resistance, capacitance, reluctance, frequency, or the combination thereof. The electric module 202 may receive the dimensional characteristics of the motor 108 and the characteristics of the electric power from the operator of the air handling unit 100. Upon receiving the first input, the electric module 202 processes the dimensional characteristics of the motor 108 and the characteristics of the electric power along with the first input to determine the heat generated from the motor 108.

At step 308, the method 300 includes determining the density of air received through the air inlet duct 110 based on the heat generated from the motor 108 and the second input. The processing unit 130 receives the second input from the second sensing device 124. Upon receiving the second input, the processing unit 130 may process the heat generated from the motor 108 along with the second input, and then determine the density of air. In an alternate embodiment, the air property module 204 disposed in communication with the second sensing device 124 and the electric module 202 receives the second input and the heat generated from the motor 108. Upon receiving the second input and the heat generated from the motor 108, the air property module 204 determines the density of air received through the air inlet duct 110.

At step 310, the method 300 includes determining the actual air flow rate based on the density of air, the speed of the motor 108 and the dimensional characteristics of the air handling unit 100. The speed sensor 210 disposed in communication with the processing unit 130 communicates the speed of the motor 108 with the processing unit 130. In another embodiment, the first sensing device 122 disposed in communication with the processing unit 130 communicates the speed of the motor 108 with the processing unit 130. Upon receiving the density of air and the speed of the motor 108, the processing unit 130 may process the dimensional characteristics of the air handling unit 100 stored in the memory module 132 along with the density of air and the speed of the motor 108, and then determine the actual air flow rate of the air mover 104. In an alternate embodiment, the hydraulic module 208 disposed in communication with the air property module 204, the mechanical module 206 and the speed sensor 210 receives the density of air, the dimensional characteristics of the air handling unit 100, and the speed of the motor 108, respectively. The mechanical module 206 stores the dimensional characteristics of the motor 108 and the dimensional characteristics of the air inlet duct 110, and then determines the dimensional characteristics of the air handling unit 100. Upon receiving the inputs indicative of the density of air, the speed of the motor 108 and the dimensional characteristics of the air handling unit 100, the hydraulic module 208 processes the inputs to determine the actual air flow rate.

At step 312, the method 300 includes comparing the actual air flow rate with the target air flow rate stored in the processing unit 130. The processing unit 130 may receive the target air flow rate from the operator of the air handling unit 100. Upon determining the actual air flow rate, the processing unit 130 compares the actual air flow rate with the target air flow rate. In an alternate embodiment, the control module 212 disposed in communication with the hydraulic module 208 receives the actual air flow rate from the hydraulic module 208. Further, the control module 212 compares the actual air flow rate with the target air flow rate stored in the control module 212.

At step 314, the method 300 includes controlling the speed of the motor 108 when the actual air flow rate is different from the target air flow rate. Upon comparing the actual air flow rate with the target air flow rate, the processing unit 130 in communication with the motor 108 controls the speed of the motor 108 to match the actual air flow rate with the target air flow rate. In an alternate embodiment, the control module 212 disposed in communication with the motor 108 and the hydraulic module 208, controls the speed of the motor 108 based on the difference value between the target air flow rate and the actual air flow rate. The control module 212 may be in communication with the electric power supplied to the motor 108 to increase the speed of the motor 108 by adjusting the current, voltage or the combination thereof, when the actual air flow rate is less than the target air flow rate.

INDUSTRIAL APPLICABILITY

The present disclosure relates to the system 120 and the method 300 for controlling the air flow rate of the air mover 104 in the air handling unit 100 in real time. The system 120 includes the first sensing device 122 and the second sensing device 124 to capture the first input indicative of the electric power supplied to the motor 108 and the second input indicative of the properties of air received through the air inlet duct 110, respectively. The system 120 further includes the processing unit 130 which is in communication with the first sensing device 122 and the second sensing device 124. The processing unit 130 is designed and developed in such a way to determine the air flow rate in real time based on the various input parameters either detected in real time or stored in the processing unit 130. The input parameters include the first input including the voltage and current of the electric power, the second input including the pressure, temperature and humidity of the air received within the air handling unit 100, the dimensional characteristics of the motor 108, the air inlet duct 110 and the air handling unit 100, the density of air, characteristics of the electric power such as the resistance, capacitance, reluctance, frequency, or the combination thereof and the speed of the motor 108. In one implementation of the present disclosure, the processing unit 130 may be designed to perform the above-mentioned operations as a single unit. In another implementation, the processing unit 130 may be designed with multiple modules such as the electric module 202, the air property module 204, the mechanical module 206, the hydraulic module 208 and the control module 212 to individually perform the above-mentioned operations.

Typically, the air handling unit 100 may include a controller to detect some or all of the above-mentioned input parameters and to control operation of components such as the air mover 104. Accordingly, in some implementation of the system 120 and the method 300 of the present disclosure, the processing unit 130 may include only the electric module 202, the air property module 204, the mechanical module 206, and the hydraulic module 208 and designed to work synchronously with the controller, or the control module 212, to perform the above-mentioned operations. Thus, the system 120 of the present disclosure may be retrofitted with the existing air handling unit and may be programmed to coordinate with the control module 212 with less modification or no modification. Further, the system 120 may be implemented in machines including, but not limited to, pumps and turbines that are associated with the air flow.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. A system for controlling air flow in an air handling unit having an air mover, the system comprising:

a first sensing device configured to receive a first input indicative of an electric power supplied to the air handling unit;

a second sensing device configured to receive a second input indicative of properties of air received within the air handling unit; and a processing unit in communication with the first sensing device and the second sensing device, the processing unit being configured to:

determine heat generated from a motor of the air mover based on the first input;

determine density of air received through an air inlet duct of the air handling unit based on the heat generated from the motor, and on the second input;

determine an actual air flow rate based on the density of the air, a speed of the motor, and dimensional characteristics of the air handling unit;

compare the actual air flow rate with a target air flow rate stored in the processing unit; and control the speed of the motor when the actual air flow rate is different from the target air flow rate.

2. The system of claim 1, wherein the first sensing device is in communication with the motor, and wherein the first input indicative of the electric power comprises current, voltage or a combination thereof.

3. The system of claim 1, wherein the second sensing device is in communication with the air inlet duct, and wherein the second input indicative of the properties of air comprises pressure, temperature, humidity or a combination thereof.

4. The system of claim 1, wherein the processing unit comprises an electric module configured to:

store dimensional characteristics of the motor and characteristics of the electric power;

receive the first input indicative of the electric power; and determine the heat generated from the motor based on the dimensional characteristics of the motor, the characteristics of the electric power, and the first input.

5. The system of claim 4, wherein the characteristics of the electric power comprises resistance, capacitance, reluctance, frequency, or a combination thereof.

6. The system of claim 4, wherein the processing unit further comprises an air property module in communication with the electric module and configured to determine the density of the air based on the heat generated from the motor and the second input.

7. The system of claim 6, wherein the processing unit further comprises a mechanical module configured to:

store the dimensional characteristics of the motor and dimensional characteristics of the air inlet duct; and determine the dimensional characteristics of the air handling unit based on the stored dimensional characteristics of the motor and the air inlet duct.

8. The system of claim 7, wherein the processing unit further comprises a hydraulic module in communication with the air property module and the mechanical module, and configured to:

receive the density of the air;

receive the dimensional characteristics of the air handling unit;

receive the speed of the motor; and determine the actual air flow rate based on the density of the air, the dimensional characteristics of the air handling unit, and the speed of the motor.

9. The system of claim 8 further comprising a speed sensor in communication with the motor and configured to communicate the speed of the motor with the processing unit.

10. The system of claim 8, wherein the first sensing device is configured to communicate the speed of the motor with the processing unit.

11. The system of claim 8, wherein the processing unit further comprises a control module in communication with the hydraulic module, and configured to:

store the target air flow rate;

compare the actual air flow rate with the target air flow rate; and increase the speed of the motor when the actual air flow rate is less than the target air flow rate.

12. A method of controlling air flow in an air handling unit having an air mover the method comprising:

receiving, by a first sensing device, a first input indicative of an electric power supplied to the air handling unit;

receiving, by a second sensing device, a second input indicative of properties of air received within the air handling unit;

determining, by a processing unit, heat generated from a motor of the air mover based on the first input;

determining, by the processing unit, density of air received through an air inlet duct of the air handling unit based on the heat generated from the motor, and on the second input;

determining, by the processing unit, an actual air flow rate based on the density of the air, a speed of the motor and dimensional characteristics of the air handling unit;

comparing, by the processing unit, the actual air flow rate with a target air flow rate stored in the processing unit; and controlling, by the processing unit, the speed of the motor when the actual air flow rate is different from the target air flow rate.

13. The method of claim 12, wherein the first input indicative of the electric power comprises current, voltage or a combination thereof.

14. The method of claim 12, wherein the second input indicative of the properties of air comprises pressure, temperature, humidity or a combination thereof.

15. The method of claim 12 further comprising:

storing, by an electric module of the processing unit, dimensional characteristics of the motor and characteristics of the electric power;

receiving, by the electric module, the first input indicative of the electric power; and determining, by the electric module, the heat generated from the motor based on the dimensional characteristics of the motor, characteristics of the electric power, and the first input.

16. The method of claim 12 further comprising, determining, by an air property module of the processing unit, the density of air based on the heat generated from the motor and the second input.

17. The method of claim 12 further comprising:

storing, by a mechanical module of the processing unit, the dimensional characteristics of the motor and dimensional characteristics of the air inlet duct; and determining, by the mechanical module, the dimensional characteristics of the air handling unit based on the stored dimensional characteristics of the motor and the air inlet duct.

18. The method of claim 12 further comprising:

receiving, by a hydraulic module of the processing unit, the density of the air;

receiving, by the hydraulic module, the dimensional characteristics of the air handling unit;

receiving, by the hydraulic module, the speed of the motor; and determining, by the hydraulic module, the actual air flow rate based on the density of air, the dimensional characteristics of the air handling unit, and the speed of the motor.

19. The method of claim 12 further comprising:

storing, by a control module of the processing unit, the target air flow rate;

comparing, by the control module, the actual air flow rate with the target air flow rate; and increasing, by the control module, the speed of the motor when the actual air flow rate is less than the target air flow rate.

* * * * *